US007282672B2

(12) United States Patent
Wurm

(10) Patent No.: US 7,282,672 B2
(45) Date of Patent: Oct. 16, 2007

(54) BAKING OVEN

(75) Inventor: Josef Wurm, Feichten (DE)

(73) Assignee: BSH Bosch und Siemens Haugeraete GmbH, Munich (DE)

( * ) Notice: Subject to any disclaimer, the term of this patent is extended or adjusted under 35 U.S.C. 154(b) by 123 days.

(21) Appl. No.: 10/560,490

(22) PCT Filed: Jun. 21, 2004

(86) PCT No.: PCT/EP2004/006697

§ 371 (c)(1),
(2), (4) Date: Dec. 12, 2005

(87) PCT Pub. No.: WO2005/001342

PCT Pub. Date: Jan. 6, 2005

(65) Prior Publication Data

US 2007/0102416 A1 May 10, 2007

(30) Foreign Application Priority Data

Jun. 23, 2003 (DE) ..... 103 28 069

(51) Int. Cl.

| | |
|---|---|
| ***F27D 1/12*** | (2006.01) |
| ***F24C 7/08*** | (2006.01) |
| ***F24C 15/32*** | (2006.01) |
| ***A21B 3/04*** | (2006.01) |
| ***A21B 1/40*** | (2006.01) |

(52) U.S. Cl. ..... 219/400; 219/391; 126/21 A; 126/273 R

(58) Field of Classification Search ..... None
See application file for complete search history.

(56) References Cited

U.S. PATENT DOCUMENTS 3,310,046 A 3/1967 Scott et al.

(Continued)

FOREIGN PATENT DOCUMENTS

DE 38 39 657 5/1990

(Continued)

OTHER PUBLICATIONS

International Search Report PCT/EP2004/006697.

*Primary Examiner*—Joseph Pelham
(74) *Attorney, Agent, or Firm*—Russ W. Warnock; Craig J. Loest; James E. Howard

(57) ABSTRACT

A baking oven including an oven muffle which includes at least one thermal heating element and which can be heated to various operational temperatures, i.e. a standard baking and roasting temperature and a high cleaning temperature (pyrolysis). The baking oven also includes a cooling fan arranged downstream from a ventilation shaft in order to guide heated air which is formed away from the inside of the baking oven to the outside thereof. According to the invention, at least one part of the ventilation shaft can be automatically adjusted according to various characteristics of the fan to form various cross-section flows by operation of a freely pivotable flap, in order to dispense with cumbersome conventional control measures.

5 Claims, 1 Drawing Sheet

Figure 1:
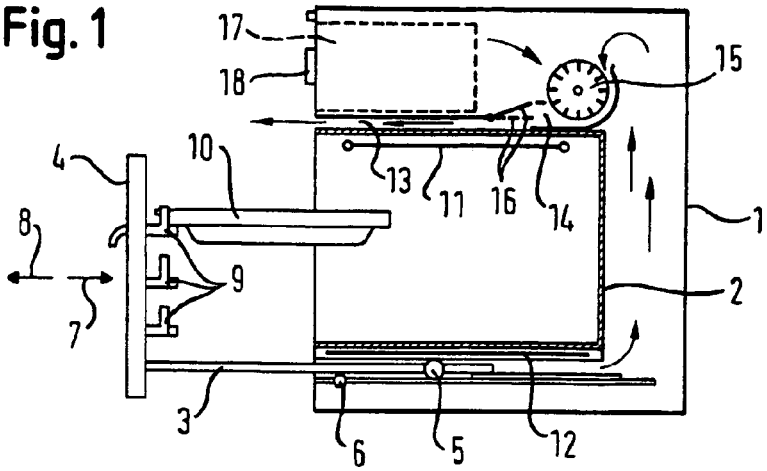

U.S. PATENT DOCUMENTS 3,416,509 A * 12/1968 Huebler et al. ..... 126/21 A
3,659,578 A 5/1972 Davis et al.
3,911,893 A 10/1975 Baker et al.
4,115,678 A * 9/1978 Tachikawa et al. ..... 126/21 A
4,654,508 A 3/1987 Logel et al.
5,676,044 A * 10/1997 Lara, Jr. ..... 219/400
6,227,189 B1 5/2001 Dougherty
6,603,102 B2 * 8/2003 Brown et al. ..... 219/400

FOREIGN PATENT DOCUMENTS

GB 1 336 803 11/1973
JP 2005-149740 A * 6/2005

* cited by examiner

BAKING OVEN

The invention relates to a baking oven comprising an oven muffle containing thermal heating elements which can be heated to different operating temperature levels, such as standard baking and roasting temperature on the one hand and high temperature for pyrolytic cleaning of the oven muffle on the other hand, inside a baking oven housing and comprising a cooling fan which is arranged between oven muffle and housing wall and which can be adjusted to different fan powers, whose delivery side is connected to a small-cross-section ventilation shaft which vents into the open air.

Devices which can influence the flow relationships in a ventilation shaft of a pyrolytically self-cleaning baking oven which leads into the open are known. For example, in such a baking oven (U.S. Pat. No. 3,659,578) the outlet opening of the ventilation shaft which vents into the open is closed by a damper during normal roasting and baking operation whereby no air flow takes place in the shaft whereas during self-cleaning operation, that is when the baking oven is heated to a high operating temperature of about 500° C., this damper is brought into the open position by a lever gear so that the highly heated cooling air flowing around the oven muffle can flow through the ventilation shaft out into the open. In another baking oven (U.S. Pat. No. 3,310,046) which can be operated at high temperature for self-cleaning purposes a cooling chamber communicating with the periphery of the oven is provided above the oven muffle, having a flow opening with a blower positioned therein arranged at its end facing the front side of the oven, which opening is in flow communication with an outwardly venting exhaust air shaft. During normal operation of the baking oven said flow opening with blower is closed by a shut-off flap whereas in high-temperature operation this shut-off flap is open to allow a flow of cooling air and serve as an indicator for the respective operating mode.

In baking ovens with heat cleaning of newer design, especially so-called built-in ovens with laterally adjacent kitchen furniture, a cooling air flow forcibly produced by a cooling fan has been made to take place even during normal baking and roasting operation in order to especially reduce the lateral ambient temperature. Since at the same time it is desirable to keep as small as possible the space requirement for the cooling air section, that is for the outwardly-venting ventilation shaft which is usually arranged above the oven muffle and its insulation and its adjacent cooling air fan, and consequently to arrange the ventilation shaft as low as possible and thereby keep the flow cross-section small, flow-technology and especially acoustic problems arise. Since, for example, in the known cross-flow fans a minimum fan motor power must be maintained even for normal operation of the baking oven to avoid start-up problems of the motor, as a result of the small cross-section of the ventilation shaft, a disturbing flow noise can be detected at this reduced fan power compared with the increased fan power in high-temperature operation as a consequence of the still-high back pressure at the entrance to the ventilation shaft, which back pressure can also result in an undesirable "run-up" of the fan motor. This means that in high-temperature operation a very much higher air throughput through the ventilation shaft is required compared with normal operation which for both operating modes means that in normal operation of the baking oven an unnecessarily high back pressure builds up at the ventilation shaft, associated with the afore-mentioned disadvantages.

It is now the object of the present invention to improve the baking oven described initially with regard to the cooling air system so that without particular expenditure, e.g. on electronic control means for the fan motor on the one hand, a high air throughput in the ventilation shaft is obtained during high-temperature operation but avoided during normal operation and when the motor power is reduced above a pre-determined motor power at the ventilation shaft an especially acoustically disadvantageous and perturbing back pressure is avoided.

This object is achieved according to the invention in the baking oven of the type described initially by the fact that a part of the ventilation shaft is automatically adjustable to form different flow cross-sections by means of the back pressures of the air flow leaving the cooling fan which are dependent on the different fan powers.

For this purpose, according to a preferred embodiment of the invention, it is provided that for adjusting the flow cross-sections, the partial area of the ventilation shaft directly adjacent to the delivery-side flow opening of the cooling fan, is constructed as a flap which is automatically adjustable to different opening positions in relation to the exhaust vent of the cooling fan by means of the respective fan back pressure.

At reduced motor power and flow rate for normal operation of the baking oven, the part of the ventilation shaft preferably constructed as a flap automatically moves merely by its weight into a position in which part of the air flow leaving the cooling fan is led off and does not enter into the ventilation shaft. In this reduced cross-sectional position no back pressure will build up at the inlet side of the ventilation shaft so that the afore-mentioned problems no longer arise. Nevertheless, the quantity of air introduced into the ventilation shaft is still sufficient to effectively cool the periphery of the baking oven during normal operation. In high-temperature operation, that is at increased motor power, the flap is again automatically adjusted by the higher air flow into a position in which the input-side end of the ventilation shaft is enlarged in cross-section and the entire amount of air leaving the cooling fan can enter into the ventilation shaft.

According to a further embodiment of the invention the partial area of the ventilation shaft facing the exhaust vent of the cooling fan can be adjusted by the flap into a position at least approximately in alignment with the full exhaust vent and into a position which is only partially in alignment with the exhaust vent and which receives only a partial quantity of the air stream leaving the exhaust vent. In this case, the ventilation shaft is advantageously constructed such that the partial area of the ventilation shaft facing the cooling fan has a cross-sectional shape corresponding to the cross-sectional shape of the exhaust vent of the cooling fan with a lower and optionally lateral fixed shaft wall and with an upper shaft wall which forms the flap and can be rotated such that it is delimited by a stop. The embodiments described hereinbefore result in a design of cooling air system which has a particularly simple construction and is inexpensive with regard to the few individual parts. Actuating elements such as actuators, restoring springs and the like are superfluous here. A particularly favourable and low-friction embodiment of the flap mounting is obtained if the flap is mounted by means of a knife-edge bearing on a fixed portion of the ventilation shaft such that it can rotate and is delimited by a stop.

Further details of the invention are obtained from the exemplary embodiment shown in the drawings and described hereinafter.

Figure 2:
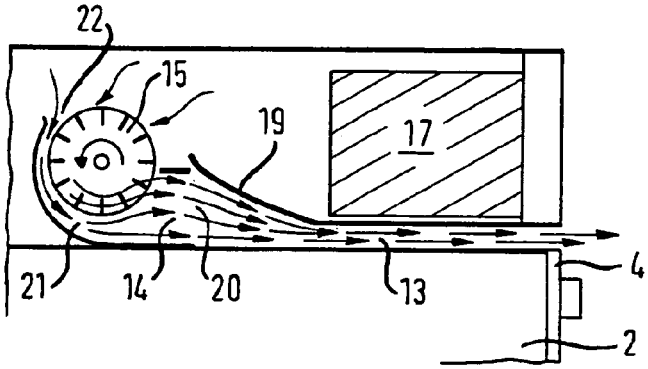
Figure 3:
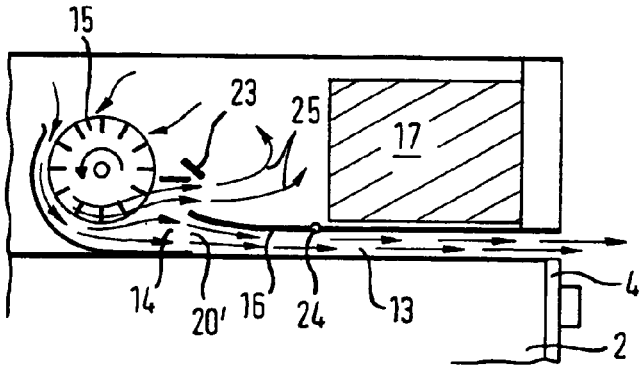
Figure 4:
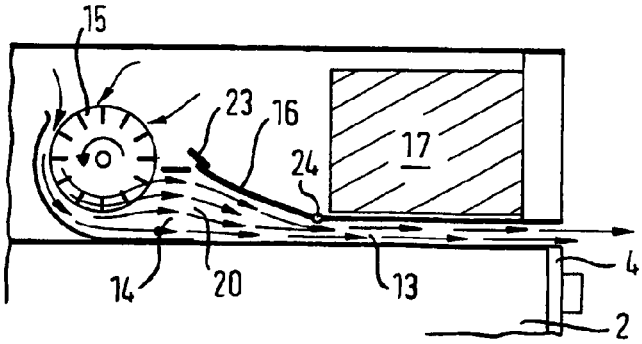

In the figures:

FIG. 1 is a schematic sectional view of a baking oven containing the cooling system according to the invention, FIG. 2 is an enlarged view of a cooling air system as a detail without the measures according to the invention, FIGS. 3 and 4 are enlarged details according to FIG. 2 in the design according to the invention with different positions of the ventilation shaft flap and specifically during normal operation in FIG. 3 and during high-temperature operation of the baking oven in FIG. 4.

In the exemplary embodiment according to FIG. 1, an oven muffle 2 surrounded by an insulating layer is arranged inside an oven housing 1, whose loading opening can be closed by an oven door 4 affixed in an angularly rigid manner on runners 3. The runners are mounted in a known fashion on rollers 5, 6 underneath the oven muffle 2 and can thus be slid in a drawer-like fashion in the closing direction 7 or in the opening direction 8. Fixing elements 9 for suspendable food carriers 10 are arranged on the inside of the oven door 4. Located at the top inside the oven muffle 2 is a radiant heater 11 as so-called upper heat and located underneath the oven muffle 2 is a lower heat 12. Also located above the oven muffle 2 is a ventilation shaft 13 which is very narrow in height, which is fluid-dynamically connected to the exhaust vent of a cooling fan constructed as a cross-flow fan, for example. A portion of the ventilation shaft 13 directly adjacent to the cooling fan 15 is constructed as a pivotally mounted flap 16, both possible operating positions of this flap 16 being indicated in FIG. 1. Located in the upper area of the oven housing 1 and above the ventilation shaft 13 is a compartment 17 which contains electrical or electronic elements or devices which can be actuated by means of a control element 18, for example. The arrows indicate air flows which are extracted on the suction side of the fan during operation of the cooling fan 15 and specifically from the rear and lateral periphery of the oven muffle 2 and from the area of the switch compartment 17. The air flow heated during operation is introduced into the ventilation shaft 13 via the delivery side of the cooling fan 15 and from there is vented to the outside as indicated by an arrow. The baking oven described should be able to operate in normal operation, that is during normal baking and roasting operation at operating temperatures within the oven muffle 2 up to about 250° C. and in so-called high-temperature operation for pyrolytic self-cleaning of the contaminated oven walls at temperature of about 500° C. Especially during high-temperature operation it is necessary to cool the interior of the oven housing 1, i.e. the periphery of the oven muffle 2, by relatively vigorous cooling of the heated air. During normal operation however, the operating heat is removed at lower fan power, e.g. to protect heat-sensitive electronic components inside the switch compartment 17 from overheating and furthermore to prevent heating of the side walls of the oven housing 1 to which oven walls built-in kitchen furniture is usually adjacent.

FIG. 2 shows the conventional arrangement of a cooling air system with a narrow ventilation shaft 13 which expands in a funnel shape by means of an upwardly bent portion 19 facing the cooling fan 15 and whose inflow opening 20 has substantially the same cross-section as the cross-section of the exhaust vent 14 of the cooling fan 15, i.e., the aforesaid openings are substantially in alignment with one another. The cooling fan 15 is partly surrounded in a known fashion by a flow channel 21 comprising a suction intake 22 and an exhaust vent 14. In practice, it has been found that also or especially when the air throughput during normal operation of the baking oven is low, that is when the cooling fan 15 is operated at a lower motor power compared with high-temperature operation, of 10 W for example and a lower flow rate in and before the ventilation shaft 13, a static pressure or back pressure builds up and there is the risk that the motor of the cooling fan 15 runs up in relation to the rotational speed and a strong perturbing flow noise is noticeable.

FIGS. 3 and 4 illustrate the solution of this problem according to the invention. In this case, as already indicated in FIG. 1, the part of the ventilation shaft 13 directly adjacent to the cooling fan is constructed as a flap 16 which flap can be pivoted about a pivot bearing 24. FIG. 4 shows the flap 16 during high-temperature operation, that is during a pyrolytic self-cleaning operating mode of the baking oven. In this case, the pivotable flap 16 is automatically pivoted upwards as far as the stop 23 in FIG. 4 by means of the high air flow so that the cross-section of the inlet opening 20 of the ventilation shaft 13 substantially corresponds to the cross-section of the exhaust vent 14 of the cooling fan 15, is in alignment therewith. Thus, in this position of the flap 16 the same relationships prevail as in the example shown in FIG. 2, i.e. the air heated in the oven housing flows in the flow channel of the ventilation shaft 13 at a relatively high flow rate and removal intensity. In this case, the cooling fan 15 is operated at a motor power of about 28 W.

After high-temperature operation has been completed, that is after the cooling fan 15 has been switched off, as a result of the gravitational force acting thereon, the flap automatically fall down into the position according to FIG. 3 in which the flap 16 is again delimited by a stop in a manner not shown. In this position, the cross-section of the inlet opening 20' is only in alignment with a part of the cross-section of the exhaust vent 14 of the cooling fan 15. When the baking oven is switched on to carry out a normal baking or roasting process (normal operation) the flap 16 stays in the aforesaid position. In this position the air flow arriving from the cooling fan 15 is divided into an air flow introduced into the ventilation shaft 13 and an auxiliary air flow according to the arrows 25 which does not enter into the ventilation shaft 13 and cannot contribute to the build-up of a high back pressure. In accordance with the very low or non-existent back pressure which now prevails, the flap remains in this position and the advantage is obtained that as a result of the relatively small amount of flow, no substantially flow noises can be noticed but the amount of out-blown air is still sufficient to effectively cool the baking oven in normal operation. The respective position of the flap 16 is thus automatically controlled depending on the respective motor power.

The ventilation shaft is advantageously constructed with a lower shaft wall directly adjacent to the oven muffle 2 and optionally with lateral, likewise fixed shaft walls and with the flap 16 lightly mounted on the upper fixed part of the ventilation shaft 13, preferably by means of a so-called knife-edge bearing in order to reduce bearing frictional forces.

The invention claimed is:

1. A baking oven, comprising:

an oven muffle containing at least one thermal heating element which can be heated to different operating temperature levels, including standard baking and roasting temperatures on the one hand and a high temperature for pyrolytic cleaning of the oven muffle;

the oven muffle located inside a baking oven housing and including a cooling fan arranged between said oven muffle and a housing wall of said baking oven housing, said cooling fan adjustable to different fan powers;

said cooling fan delivery side connected to a ventilation shaft opening into the open air outside of said baking oven housing; and at least one part of said ventilation shaft automatically adjustable to form different flow cross-sections in accordance with the back pressures of the air flow leaving said cooling fan, said back pressures of said air flow depending on said different fan powers.

2. The baking oven according to claim 1, wherein adjusting said flow cross-sections includes the partial area of the ventilation shaft directly adjacent to a delivery-side exhaust vent of said cooling fan constructed as a flap automatically adjustable to different opening positions in relation to said exhaust vent of said cooling fan in accordance with said respective fan back pressure.

3. The baking oven according to claim 2, including said partial area of said ventilation shaft facing said exhaust vent of said cooling fan adjusted by said flap into a first position at least approximately in alignment with the full exhaust vent and into a second position only partially in alignment with said exhaust vent and which receives only a partial quantity of the air stream leaving said exhaust vent.

4. The baking oven according to claim 3, including said ventilation shaft constructed with a lower and optionally lateral fixed shaft wall and with an upper shaft wall which forms said flap and said flap can be rotated to a position delimited by a stop.

5. The baking oven according to claim 4, including said flap mounted by a knife-edge bearing on a fixed portion of said ventilation shaft such that said flap can rotate to a position delimited by said stop.

* * * * *